US005203141A

United States Patent [19]

Berciga et al.

[11] Patent Number: 5,203,141

[45] Date of Patent: Apr. 20, 1993

[54] APPARATUS AND METHOD FOR FILLING A CANNING CONTAINER WITH A SHAPED FOODSTUFF PRODUCT, SUCH AS TUNA FISH

[75] Inventors: Stefano Berciga, Fontanellato; Dino Bertani; Luigi Salati, both of Parma, all of Italy

[73] Assignee: FMC Corporation, Chicago, Ill.

[21] Appl. No.: 864,698

[22] Filed: Apr. 7, 1992

[30] Foreign Application Priority Data

Apr. 19, 1991 [IT] Italy ..... MI91 A001078

[51] Int. Cl.[5] ..... B65B 63/02; B65B 37/20

[52] U.S. Cl. ..... 53/435; 53/439; 53/517; 53/530

[58] Field of Search ..... 53/435, 439, 438, 529, 53/530, 517; 100/98 R, 96, 97, 94; 426/518, 513

[56] References Cited

U.S. PATENT DOCUMENTS 2,926,095 2/1960 Gorby ..... 53/517 X 3,124,469 3/1964 Carruthers ..... 53/517 X 3,700,386 10/1972 Mencacci ..... 53/435 X 4,116,600 9/1978 Dutton et al. ..... 53/517 X 4,641,487 2/1987 Darecchio ..... 53/435

*Primary Examiner*—James F. Coan

*Attorney, Agent, or Firm*—Raymond E. Parks; Richard B. Megley

[57] ABSTRACT

An apparatus for filling two cylindrical canning containers with cylindrically compacted and shaped tuna chunks. The apparatus has a flared compression channel for relieving excessive compression in the compacted tuna chunks, a movable shaping wall for controlling the density of the tuna chunks by changing the volume of the channel, and a movable blade between two semi-cylindrical cavities in the shaping wall for splitting the relieved compacted tuna chunks into two streams which then flow easily into the cavities for forming semi-cylindrical ends prior to cutting the formed ends into cylindrical cakes for injection into the canning containers.

7 Claims, 3 Drawing Sheets

APPARATUS AND METHOD FOR FILLING A CANNING CONTAINER WITH A SHAPED FOODSTUFF PRODUCT, SUCH AS TUNA FISH

BACKGROUND OF THE INVENTION

This invention relates to an apparatus and method for filling a canning container with a shaped foodstuff product, such as tuna fish.

1. Field of the Invention

Because of the known characteristics of tuna fish and the problems associated with the intrinsic nature of this foodstuff the subject invention is particularly suited for the canning of tuna fish. The invention provides a machine, device or apparatus which shears fillets of tuna fish according to a predetermined orientation of the tuna fish fibers into slices of tuna chunks, successively compacts the chunks into a mass and compresses the mass to a predetermined density for maintaining products of consistent size, weight and volume forms and cuts cylindrical shaped container charges of the tuna product from the compressed mass, and transfers the firm, compact, homogeneous and non-crumbly charges of the tuna product into the canning tins or containers.

2. Discussion

It is known that the automatic filling of relatively small cylindrical cans with the cylindrically shaped charges of tuna product presents various problems due to the irregular consistency of the fish fillets which makes it necessary to compact and compress the sliced tuna chunks so as to provide products of consistent weight, volume and density which are introduced into the canning containers.

One prior tuna fish canning apparatus is known from the U.S. Pat. No. 3,700,386, granted to Mencacci on Oct. 24, 1972. This prior can filling invention has an apparatus for filling only one can at a time with sliced tuna chunks which are compressed and shaped into a cylindrical pellet by a moveable shaping wall having an arcuate depression pushing on one side of the tuna chunks, while forceps-like knives having facing arcuate depressions are squeezing opposite sides of the tuna chunks. There is no way disclosed to control the weight, volume and density of the formed product prior to insertion in the can.

Another prior tuna fish canning apparatus, which is an improvement over the Mencacci device, is know from the U.S. Pat. No. 4,641,487 granted to Darecchio on Feb. 10, 1987. In this prior apparatus two charges of the cylindrically formed tuna product are ejected vertically into two canning containers. Chunks of the sliced tuna fillets are dropped by gravity, vertically into a horizontal shaping channel wherein a reciprocable extrusion plunger compacts the chunks and compresses them against a fixed lobed end of the channel. The fixed cusp between the lobes bifurcates the mass moving into the semi-cylindrical depressions forming the lobes in the fixed end wall. The semi-cylindrical surfaces also form vertical semi-cylindrical wall extensions for a pair of axially aligned upper and lower through bores, through which a pair of cylindrical hollow dies cut out a pair of cylindrical pellets from the bifurcated mass trapped in the lobes. A gate below the lower pair or through bores is opened and a pair of cylindrical pistons, concentric within the dies which have been introduced with the pellets therein into a pair of cans disposed under the lower pair of bores, are ejected from the dies into the cans, by the pistons, as the dies are retracted from the cans, without any loss of product. the Darecchio apparatus, even though it has solved various problems with prior fish can filling devices, it too has drawbacks, which have come to light during the course of its operation and use through the years.

One of the short comings is due to the high friction of the tuna chunks moving along the walls of the compression channel toward the fixed lobed end which causes an excessive compactness and therefore squeezing of the product against the container walls. The friction is further increased by the fixed position of the cusp or separating element which divides the mass into two streams entering the confines of the lobes.

Another short coming found in the known machines relates to the weight checking of the product for each tin. The only possibility of checking is often by means of adjusting the pneumatic pressure of the extrusion plunger or compression piston feeding the segments to the lobed end of the channel. This solution is not the ideal one for tuna processing machines because it may happen, during this processing, that the density of the formed cake changes considerably in consequence of quality changes of the fish or cooking conditions. If one tries to compensate for these changes by increasing or decreasing the pneumatic pressure to the compression piston, the product runs the risk to be damaged.

SUMMARY OF THE INVENTION

An object or aim of the present invention is to provide an improved fish canning machine free from the prior art inconveniences. This aim is obtained by providing the apparatus, device or machine with a compression channel wherein the cusp or cutter element, between the lobes, which divides mass into two streams entering the confines of the lobes is movable from a normal position forming the cusp of the lobes, during the compression of the tuna chunks, to an extended position upstream of the lobes when the compression has finished. The cutter element moves forward to an upstream position in the channel cutting the chunk tuna mass into two streams and dividing the compressed fibers thereof.

Another advantage of the compression channel, according to the present invention, is that the longitudinal walls which define the upper and lower narrow sides of the compression chamber diverge outwardly in the forward downstream moving direction of the tuna chunks, therefore helping in reducing the friction of the tuna chunks moving downstream toward the lobed end, by slightly expanding the mass and releasing excessive compression.

Further advantage advanced by the machine, according to the present invention, is represented by the fact that the product can be allowed to expand slightly in the flared filling zone before the lobed end of the channel, therefore obtaining a lesser squeezing of the formed pellets introduced into the canning containers.

DESCRIPTION OF THE FIGURES OF THE DRAWING

These and other advantages of the apparatus, device or machine, according to the present invention, will be evident to those skilled in the art by reading the following detailed description of the invention with reference to the various figures of the drawing wherein.

DESCRIPTION OF A PREFERRED EMBODIMENT OF THE INVENTION

Figure 1:
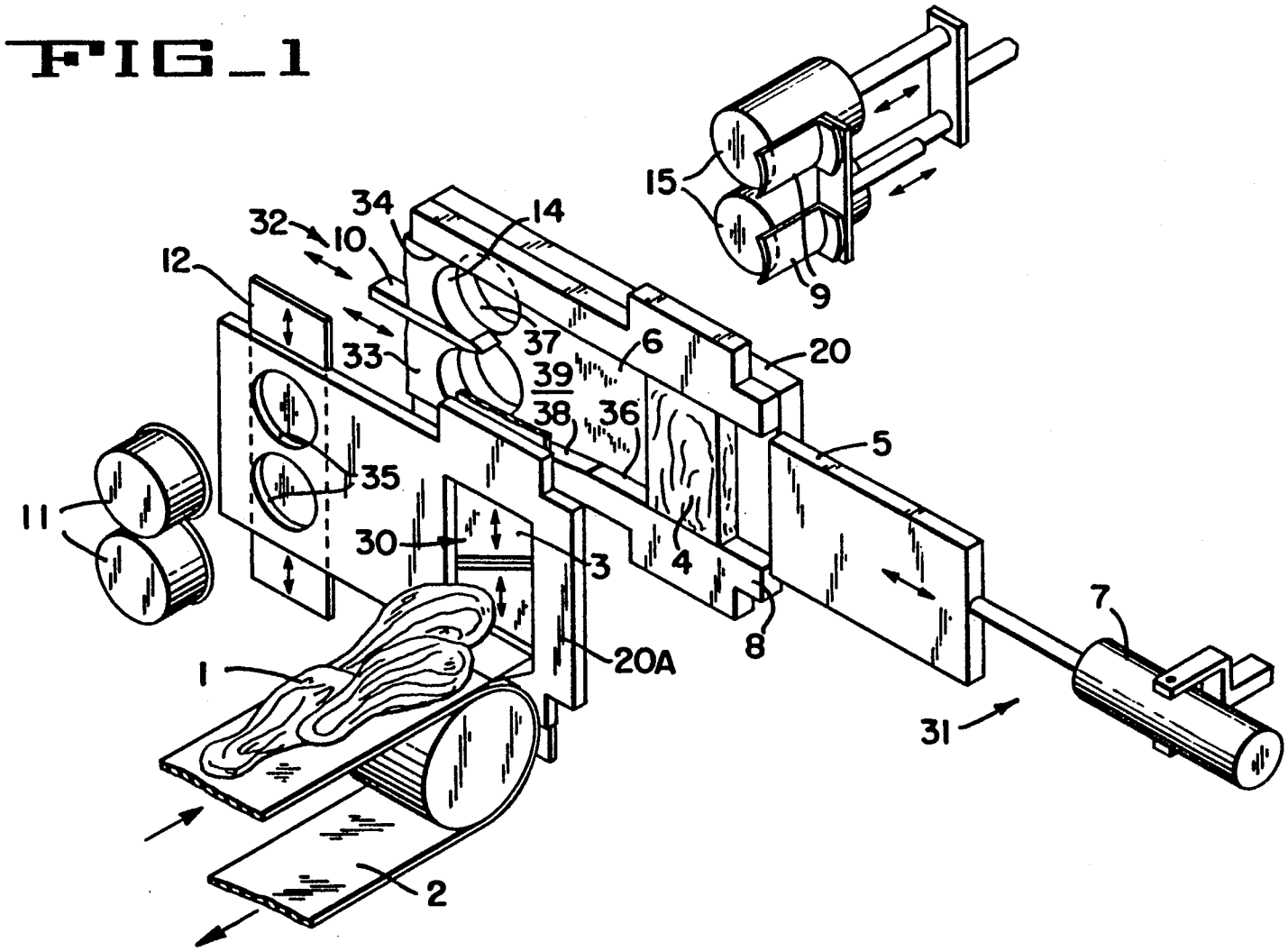
FIG. 1 is an exploded schematic perspective, with parts removed, of a fish canning apparatus according to the teachings of the present invention.

Since the machine is a dual can filling apparatus, and is symmetrical about an imaginary centerline passing horizontally through the machine, identical upper and lower parts, bores, surfaces, and the like, will be identified by a common reference numeral.

With reference to FIG. 1, a plurality of fillets of a foodstuff product, such as tuna fish fillets 1, are moved by means of the conveying belt 2, intermittently, into an opening 30 in a wide side 20A which covers one side of the channel 6. A fillet is positioned in the opening 30, which slices portions of the fillets 1 into tuna chunks 4 as the fillets are moved against the second wide wall 20 in the compression channel 6 of the device for bringing the tuna chunks to the required density for canning. The cutter 3 shown in FIG. 1 is of the mandible kind which has two opposed blades, but can also be of any other suitable kind.

The compacting tuna chunk portion 4, assumes a substantially parallelepiped shape, which is further compacted and compressed with additional sliced tuna fillets, by the extrusion plunger 5 of the compacting unit 31 which moves inside the compression channel 6 under the power of the pneumatic cylinder 7. The channel 6 comprises two lower and upper horizontal side elements 8 which are fixed between the two vertical wide sides 20, 20A of the device. The vertical end 32 of the channel 6 comprises a moveable end plate 33 having two semi-cylindrical depressions or lobes 14 which is movable along the facing surfaces of a pair of parallel wall portions 34, at a downstream end of the elements 8, and with respect to a movable wedge blade 10 separating the lobes. The tuna chunk mass after it is compressed to the desired density is then sheared into two cylindrical canning portions by the two semi-cylindrical die-cuts 9 which form two cakes 40 (FIGS. 4 and 5) from the two streams which were divided from the tuna chunk mass 4 by the movable separating wedge 10 between the lobes 8. At this stage in the operational cycle the two opposing shutters or gates 12 closing the two ejection bores 35 in the vertical wall 20A are opened to allow the two cakes 40 (FIGS. 4 and 5) to be pushed inside the two tins 11 by the dual ejection pistons 15, which are co-axially mounted inside the die-cuts 9 respectively and are horizontally reciprocable. Sets of two tins 11 feed downwardly along a vertical plane parallel to the wide side wall 20A, by any suitable container conveyor (not shown).

Figure 2:
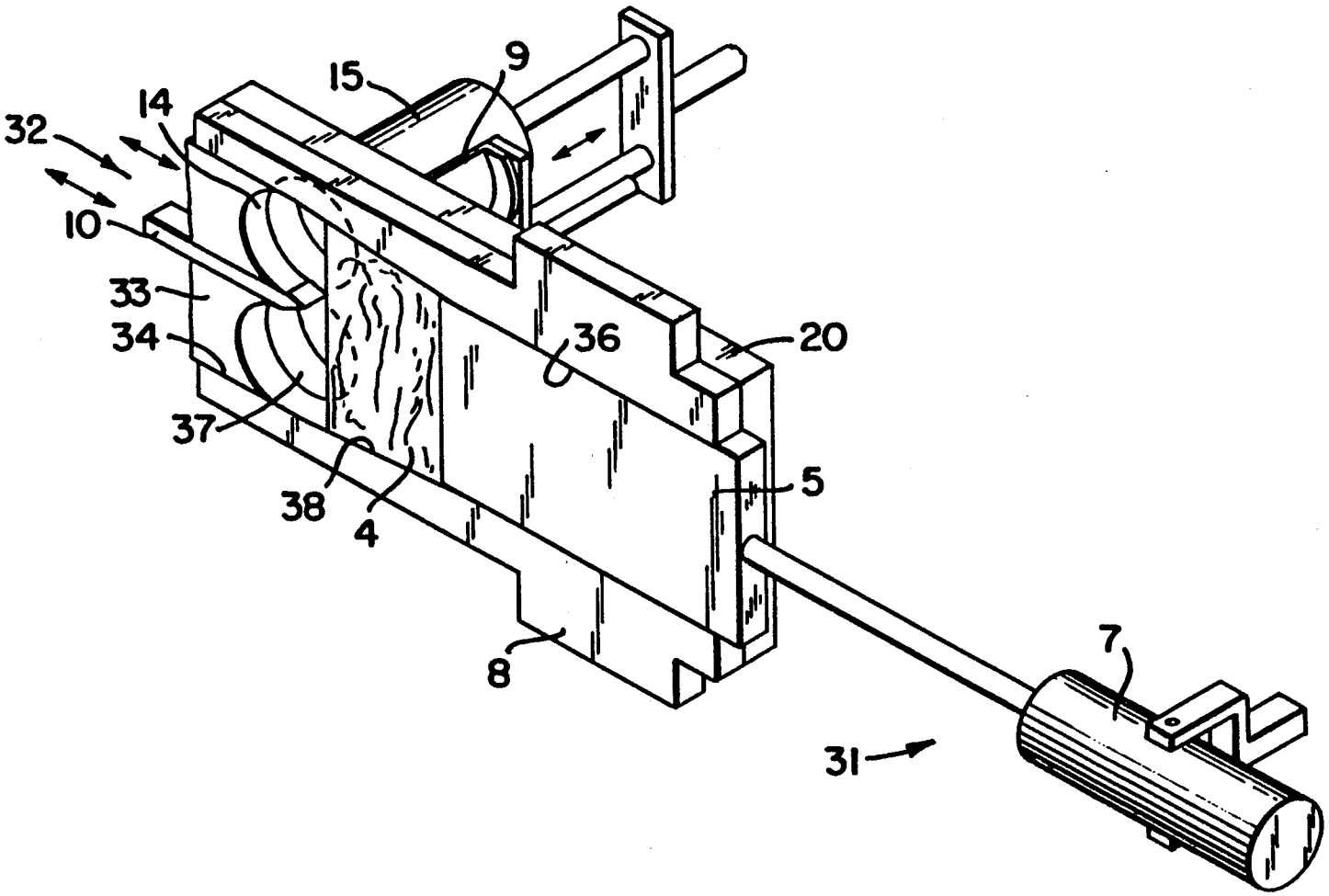
FIG. 2 is a partially assembled schematic perspective showing the working principle of the fish canning apparatus shown in FIG. 1; and, FIGS. 3, 4 and 5 show a frontal schematic view, with parts removed, of the device of FIG. 2, during three different stages of an operational cycle.

With reference to FIG. 2, a detailed description now follows of the improved device for compressing and forming the cakes 40, according to the present invention. This device is formed in a known way by the compacting unit 31 which has the extrusion plunger 5 capable of a reciprocating motion along the facing parallel wall portions 36 of the narrow sides 8 upstream inside the channel 6 and by the vertical side 32 which is provided with dual semi-cylindrical lobes 14 between which is the movable separating wedge 10. This wedge 10 remains in a normal rearward starting position, forming a cusp blade between the lobes 14, as long as the compacted tuna chunk mass 4 is being compressed by the compacting unit 5 inside the channel 6. In this arrangement, where the blade 10 is movable, with respect to the lobes 14, the excess compactness due to the friction of the two streams of the tuna mass flowing into each of the lobe 14 is reduced, which is present in the known machines wherein the dividing cusp cutter element formed between the two semi-cylindrical lobes is fixed and only cuts the tuna mass during the scallop forming step. On the contrary, the present separating wedge 10 is extended forwardly or upstream into the channel 6 in order to divide the tuna chunk mass 4 into two streams following the formation of the two cakes 40 of product when the scallops have been formed by the lobes 14 and the semi-cylindrical portions have been cut out by die-cuts 9. The forward horizontal linear motion of the separating wedge 10 is controlled by a cam (not shown) in synchrony with the transverse horizontal linear motion of the die-cuts 9 through the bores 37 in the wide vertical plate 20. When these die-cuts 9 return to the retracted starting position, the rotation of the cam (not shown) releases the separating wedge 10 which then retracts and moves rearwardly or downstream to the starting position under the action of a tension spring (not shown).

In the FIG. 2 it is also shown that a portion 39 of the internal facing walls 38 between the two parrallel wall portions 34 and 36 of channel 6 is flared outwardly toward the movable end wall 32 wherein the walls 38 diverge in the direction of the lobes 14 and intersect with the downstream parallel walls 34. Thanks to this divergence, the friction of the tuna chunk mass sliding along the upstream parallel walls 36 is further reduced when flowing into the expanding portion 39 during the compression stage; and, therefore the compression in the formed cakes 40 is also reduced due to the slight decompression of the tuna chunk mass flowing into the flared wall portion 39. Thus, the risk of a product squeezing against the walls of the tins 11 is reduced.

As previously descibed, an important characteristic of the present invention is represented by the possibility of modifying the volume of the compression channel 6 in order to balance the eventual density changes of the tuna chunks 4. For this purpose the scallop forming end 33 with the two lobes 14 is not mounted in a fixed position with respect to the vertical wide sides 20 and 20A and to the narrow horizontal side elements 8 of the device, but are capable of moving in the two directions shown by the double headed arrow in order to shorten or extend the longitudinal length of the compression channel 6 thereby changing correspondingly the volume. The maximum volume of channels 6 corresponds to the position wherein the semi-circle surfaces of the two lobes 14 are in an axially aligned position with respect to like semi-circle surfaces of the circular holes 35, 37 bored through the vertical wide sides 20 and 20A in order to permit the dual pistons 15 to extend through the channel and eject the formed cakes 40 into the tins 11. The compression channel 6 can be adjusted to the maximum volume when the processed product can be expected to have a minimum density. Eventual increases of the density can be balanced by reducing the volume of the compression channel 6 by means of moving the lobed scallop forming end 33 forwardly or upstream toward the flared portion 39 of the channel 6.

The linear motion of the scallop forming end 33 can be obtained in any known manner, so that a detailed description of such a device (not shown), is not necessary.

The channel volume adjusting device 32 of the compression channel 6 allows one to balance for eventual changes of the product density, due either to the specific gravity thereof or to the cooking temperature and pressure, without modifying the compression pressure and therefore eliminating the risk of a product damage.

Figure 3:
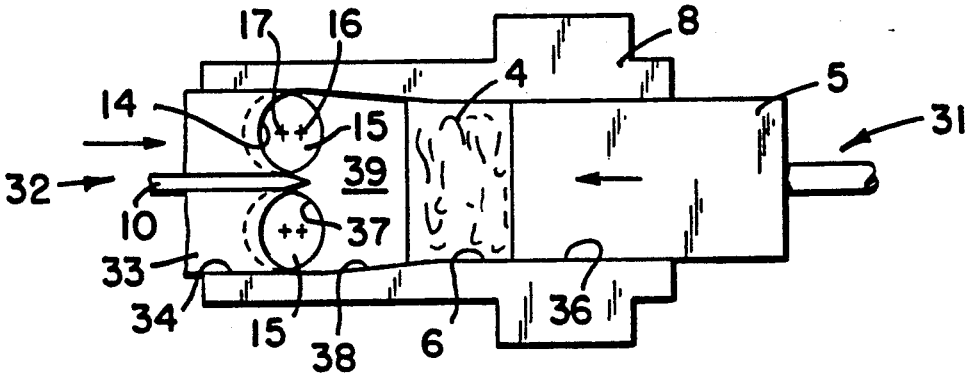

With reference to the FIG. 3, it is shown that, during the compression stage of the sliced tuna chunks 4, the piston 3 moves forwardly or downstream while the separating wedge 10 is in a normal rearward starting position which is at the end of the stroke of the cam (not shown) in order to reduce to a minimum the resistance of the tuna mass 4 to the downstream flow into the scallop forming lobes 14. In the example shown in FIGS. 3 and 4, the scallop forming end 33 is in an advanced or extended position into the channel 6, whereby the two respective horizontal axes of curvature 16 of the semi-cylindrical scallop forming surfaces 14 do not coincide with the horizontal axes 17 of the two pairs of axially aligned bores 37, 35 through which pass the dual die-cuts 9 and the concentric ejecting dual pistons 15. This situation corresponds to an adjustment done in order to reduce the volume of the compression chamber 6 when the specific gravity of the product increases with respect to the expected minimum of the formed product 40. The distance between the axes 16 and 17 can be changed in the two linear directions shown by the double headed arrow in FIG. 1 according to the density changes of the processed product.

Figure 4:
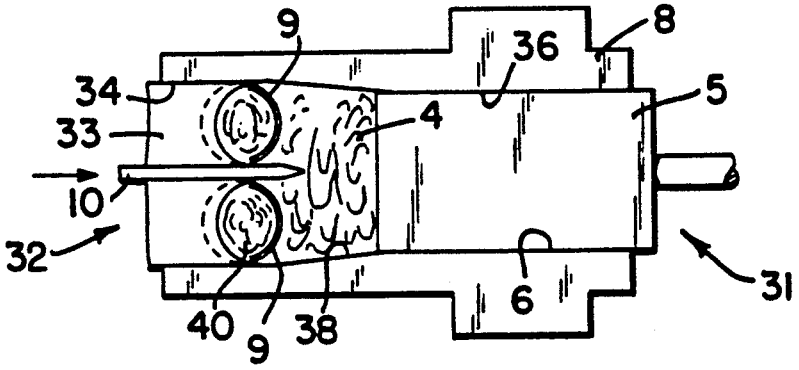

FIG. 4 shows the operative stage wherein the compression piston 5, has now moved up to the entrance of the flared portion 39 and is at the position of the end of the stroke of the pneumatic piston-cylinder unit 7; and wherein the die-cuts 9 penetrate into the scalloped formed end of the tuna mass formed in the lobes 14 and shear two cakes 40 which are isolated by the separating wedge 10; and wherein the wedge 10 is extended by the cam (not shown) into the tuna mass 4 shearing the mass into two streams for easy entry into the scallop forming lobes 14, with the next operational cycle.

Figure 5:
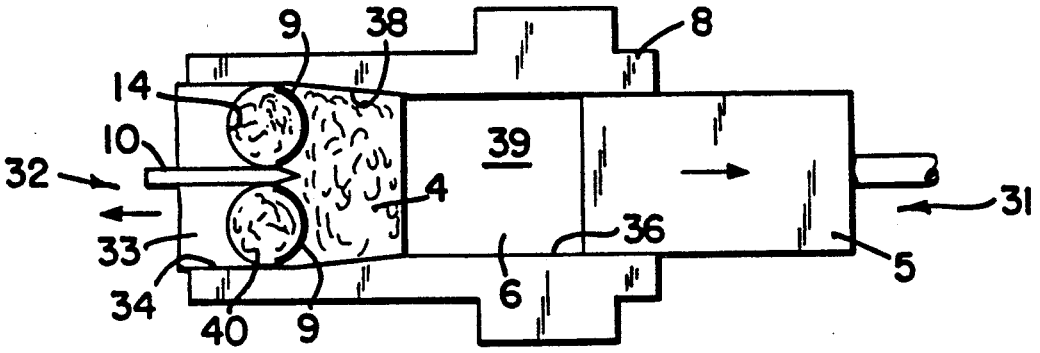

FIG. 5 shows the operative stage wherein, before the dual ejecting pistons 15 push the two formed cakes 40 into the respective dual tins 11, adjacent the two bores 35, the lobed end wall 33 has been retracted to the normal starting position in the channel 6. In this position the axes 16 of the dual lobes 14 coincide with the axes 17 of the two pair of bores 37, 35 and the co-axial horizontal axes of the paths of the dual pistons 15. In this way the axial movement of the two pistons 15 is not obstructed by the semi-cylindrical surfaces of the lobes 14 during the ejecting motion of the pistons.

The embodiment hereinabove described and illustrated in the attached drawings is to be intended as an example and not in a limitative sense of the present invention. Additions and modifications can be made to the apparatus by those skilled in the art while remaining within the scope of the present invention.

What is claimed is:

1. An apparatus for filling a canning container with a shaped foodstuff product, such as tuna tish, comprising a rectangular shaped channel for receiving sliced pieces of tuna, a plunger for compacting the pieces in the channel into a mass of a predetermined density, a shaping end wall having a pair of semi-cylindrical cavities for forming a pair of scallop-like semi-cylindrical ends in the mass, a cutter for separating the scallop-like semi-cylindrical ends in half, a pair of shaping dies for cutting the scallop-like cylindrical ends into two cylindrical cakes, and a pair of pistons for ejecting the cakes into two canning containers; wherein, the shaping end wall (33) is slidably mounted in the channel (6) for controlling the density of the mass (4) by changing the volume of the channel; and wherein, the channel is provided with a flared portion (39) for expanding the mass and releasing excessive compression adjacent the semi-cylindrical cavities (14) in the shaping end wall; characterized in that:

the cutter (10) is slidably mounted between the cavities in the shaping end wall for moving into the flated mass in the flared portion of the channel and starting two streams for easily compacting into the cavities in the shaping end wall concomitant with the shaping dies (9) cutting two preceding streams nested in and upstream of the cavities in the shaping end wall into the two cylindrical cakes (40).

2. The apparatus claimed in claim 1, characterized in that the flared portion (39) is formed by a pair of downstream diverging wall sections (38) connecting an upstream pair of parallel wall sections (36) to a downstream pair of parallel wall sections (34).

3. The apparatus claimed in claim 2, characterized in that the wall sections separate opposing wide sides (20, 20A) of the channel, and the parallel wall sections respectively form sliding surfaces for the downstream plunger (5) and the upstream shaping end wall.

4. The apparatus claimed in claim 3, characterized in that the wide sides are provided with pairs of axially aligned bores (37, 35) through which the shaping dies pass into the channel on diametrically opposite sides of the semi-cylindrical cavities in the end wall, and through with the pistons (15) pass co-axially and concentrically with the shaping dies when the axes (16, 17) of the bores, cavities, dies and pistons are axially aligned.

5. The apparatus claimed in claim 4, characterized in that the slidable cutter (10) is an elongated rectangular plate with a sharpened end.

6. The apparatus claimed in claim 5, characterized in that the wide slides are vertical sides of the apparatus.

7. A method for filling a canning container with a shaped foodstuff product comprising the steps of:

compacting slices of the foodstuff into a mass in a channel;

controlling the density of the mass by changing the volume of the channel;

moving the mass into a flared portion of the channel and relieving the mass of excessive compression;

splitting the relieved mass in the flared portion of the channel into two component streams;

flowing each stream from the flared portion of the channel into respective semi-cylindrical cavities and forming semi-cylindrical ends;

passing a cutter into the streams upstream of the semi-cylindrical ends and forming cylindrical cakes; and filling the canning containers with the cakes.

* * * * *